United States Patent [19]

Nakajima

[11] Patent Number: 5,049,043

[45] Date of Patent: Sep. 17, 1991

[54] VARIABLE CAPACITY VANE COMPRESSOR

[75] Inventor: Nobuyuki Nakajima, Konan, Japan

[73] Assignee: Diesel Kiki Co., Ltd., Tokyo, Japan

[21] Appl. No.: 497,313

[22] Filed: Mar. 22, 1990

[30] Foreign Application Priority Data

Jul. 26, 1989 [JP] Japan ..... 1-195256

[51] Int. Cl.[5] ..... F04B 49/00

[52] U.S. Cl. ..... 417/295; 417/310

[58] Field of Search ..... 417/295, 310

[56] References Cited

U.S. PATENT DOCUMENTS 4,774,731 5/1988 Nakajima et al. ..... 417/295

4,917,578 4/1990 Nakajima et al. ..... 417/295

FOREIGN PATENT DOCUMENTS 1-36997 2/1989 Japan .

*Primary Examiner*—Robert G. Nilson

*Attorney, Agent, or Firm*—Charles S. McGuire

[57] ABSTRACT

A variable capacity vane compressor in which one end face of a side block facing the rotor is formed therein with an annular recess in a bottom of which is formed a second recess. A control element rotatably received in the annular recess for varying the timing of commencement of the compressor. The control element cooperates with the second recess to define therebetween a pressure working space. The control element has a pressure-receiving protuberance slidably fitted in the pressure working space to divide same into a first pressure chamber and a second pressure chamber. A communication passage extends between the first pressure chamber and a low pressure zone. A control valve device is arranged in the communication passage for opening and closing the communication passage in response to suction pressure. A sealing device is provided in the bottom of the annular recess and engages portions of the control element other than the pressure-receiving protuberance. A high pressure-introducing passage introduces high pressure into the first pressure chamber. A restriction passage introduces high pressure into the second pressure chamber. The high pressure-introducing passage has a cross-sectional area larger than the cross-sectional area of the restriction passage. The inner wall of the pressure working space and the pressure-receiving portion defines therebetween a clearance smaller than the cross-sectional area of the restriction passage.

12 Claims, 12 Drawing Sheets

VARIABLE CAPACITY VANE COMPRESSOR

BACKGROUND OF THE INVENTION

This invention relates to a vane compressor adapted for compressing a refrigerant in air conditioners for automotive vehicles, and more particularly to a variable capacity vane compressor which is capable of changing its capacity by changing the timing of commencement of compression.

Conventional variable capacity vane compressors of this kind include one proposed, e.g. by Japanese Provisional Patent Publication (Kokai) No. 64-36997, which comprises a cylinder with its open ends closed by a pair of side blocks, and a rotor rotatably received within the cylinder, and a control element rotatable about its own axis in opposite directions for controlling the timing of commencement of compression.

The control element has one side surface thereof formed integrally with a pair of pressure-receiving protuberances projected therefrom at diametrically opposite locations. On the other hand, one of the side blocks has an end face thereof facing the rotor and formed therein with an annular recess, in which the control element is rotatably received, with each of the pressure-receiving protuberance dividing a pressure working space defined between the annular recess and the control element into a low pressure chamber and a high pressure chamber. Sealing means is mounted on the control element and fitted around required portions thereof including the pressure-receiving protuberances.

As shown in FIG. 1, the sealing means comprises a resilient sealing member (not shown) directly fitted around the control element, and an auxiliary sealing member which is formed of a resin having smaller coefficient of friction than the resilient sealing member. The auxiliary sealing member has a generally identical configuration therewith and is superimposed thereupon with its sealing surfaces 100*a* lying over respective associated surfaces of the resilient sealing member. The auxiliary sealing member comprises a first sealing portion 101 in the form of an annulus, second sealing portions 102, 102 each in the form of an arc, located at locations diametrically opposite and radially outward of the first sealing portion 101 and extending concentrically therewith, third sealing portions 103, 103, each having an inverted U-shaped configuration and bridging between one end of a corresponding one of the second sealing portions 102, 102 and the first sealing portion 101, and fourth sealing portions 104, 104, each bridging between the other end of the corresponding second sealing portion 102 and the first sealing portion 101.

The control element is rotatable in opposite directions between a minimum capacity position in which the delivery quantity of the compressor is the minimum and a maximum capacity position in which it is the maximum, in response to the difference between the sum of suction pressure as low pressure introduced into the low pressure chamber and the biasing force of a torsion coiled spring, and control pressure Pc created in the high pressure chamber by discharge pressure Pd as high pressure introduced through a restriction into the high pressure chamber. One of the high pressure chambers and a suction chamber in the compressor is communicated with each other via a communication passage across which is arranged a control valve device which opens and closes the communication passage in response to changes in the suction pressure representative of the thermal load, to thereby vary the control pressure and hence the difference between the control pressure and the above-mentioned sum force so that the control element is rotated to vary the timing of commencement of compression and hence the delivery quantity.

Conventional variable capacity vane compressors constructed as above are generally designed to start with the control element in the minimum capacity position in order to reduce starting shock. However, in the above described conventional compressor, the torsion coiled spring which biases the control element in the minimum capacity position has its biasing force preset to such a value as to overcome the rotation resistance of the control element. Consequently, to increase the delivery quantity after the start of the compressor it is necessary to impart to the control element a rotating force which is greater than the sum of the rotation resistance of the control element and the biasing force of the torsion coiled spring. However, at the start of the compressor, the compression ratio is so small that the discharge pressure Pd does not quickly rise and accordingly the control pressure Pc does not quickly rise. Consequently, the control element cannot smoothly rotate in the delivery quantity-increasing direction, resulting in poor startability of the compressor.

Furthermore, the sealing members are rather complicated or three-dimensional in configuration, requiring high precision in manufacturing the control element and hence leading to a high production cost. Besides, the higher the airtightness to be obtained by the sealing means, the higher the seal resistance, which further degrades the compressor startability.

SUMMARY OF THE INVENTION

It is, therefore, the object of the invention to provide a variable capacity vane compressor, in which the control element can be rotated with improved smoothness, thereby enhancing the startability of the compressor as well as the capacity controllability.

It is a further object of the invention to provide a variable capacity vane compressor, which employs sealing members which are simple in configuration and reduced in seal resistance.

It is another object of the invention to provide a variable capacity vane compressor, which is easy to manufacture and hence low in production cost.

To attain the above objects, the present invention provides a variable capacity vane compressor including a cylinder having a pair of side blocks, a rotor rotatably received within the cylinder, one of the side blocks having an end face thereof facing the rotor, the end face having an annular recess formed therein and at least one second recess formed in a bottom of the annular recess, a control element rotatably received in the annular recess for varying the timing of commencement of the compressor, the control element cooperating with the second recess to define therebetween at least one pressure working space, the control element having at least one pressure-receiving protuberance slidably fitted in the pressure working space to divide the pressure working space into a first pressure chamber and a second pressure chamber, a communication passage extending between the first pressure chamber and a low pressure zone, and a control valve device arranged in the communication passage for opening and closing the communication passage in response to suction pressure.

The variable capacity vane compressor according to the present invention is characterized by an improvement comprising sealing means provided in the bottom of the annular recess and engaging portions of the control element other than the pressure-receiving protuberance, a high pressure-introducing passage for introducing high pressure into the first pressure chamber, a restriction passage for introducing high pressure into the second pressure chamber, the high pressure-introducing passage having a cross-sectional area larger than a cross-sectional area of the restriction passage, the inner wall of the pressure working space and the pressure-receiving portion defining therebetween a clearance smaller than the cross-sectional area of the restriction passage.

The communication passage has a cross-sectional area larger than the cross-sectional area of the high pressure-introducing passage.

The cross-sectional area of the communication passage may be 8 to 10 times as large as the cross-sectional area of the high pressure-introducing passage.

The above and other objects, features, and. advantages of the invention will be more apparent from the ensuing detailed description taken in conjunction with the accompanying drawings.

BRIEF DESCRIPTION OF THE DRAWINGS

FIG. 7 (*b*) is a sectional view taken along line B—B in FIG. 7 (*a*);

FIG. 9 (*b*) is a sectional view taken along line C—C in FIG. 9 (*a*);

FIG. 11 (b) is a view similar to FIG. 11 (*a*), in which the control element is in the minimum capacity position;

DETAILED DESCRIPTION

The invention will now be described in detail with reference to the drawings showing embodiments thereof.

Figure 1:
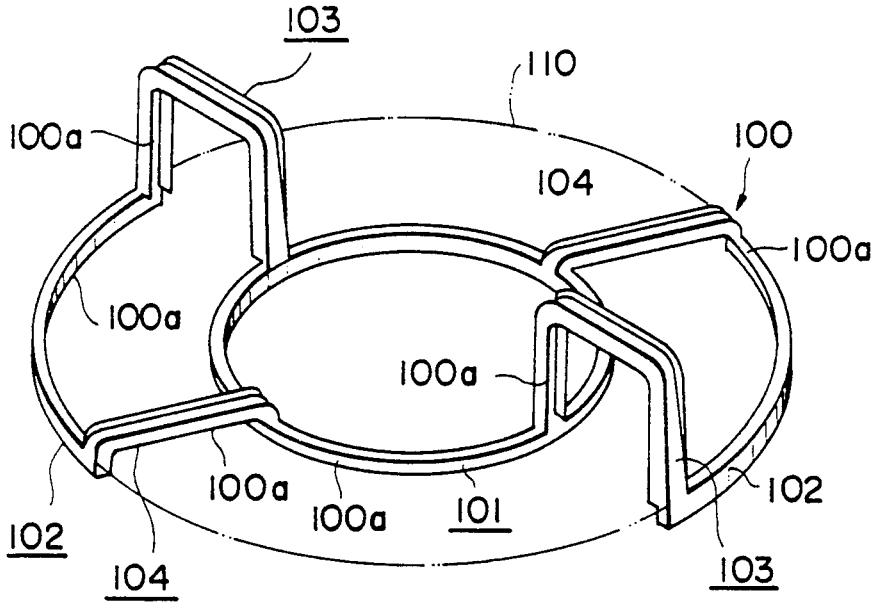
FIG. 1 PRIOR ART
FIG. 1 is a perspective view showing a conventional auxiliary sealing member of sealing means for the control element.

Referring first to FIGS. 2 through 11, there is illustrated a variable capacity vane compressor according to a first embodiment of the invention. In FIG. 1, the compressor comprises a cylinder formed by a cam ring 1 having an inner peripheral camming surface 1*a* with a generally ellipsoidal cross section, and a front side block 3 and a rear side block 4 secured to opposite open ends of the cam ring 1 in a manner closing same, a cylindrical rotor 2 rotatably received within the cylinder, a front head 5 and a rear head 6 secured to outer ends of the respective side blocks 3, 4, and a rotary shaft 7 carrying the rotor 2 secured thereon and supported by radial bearings 8, 9 provided respectively in the side blocks 3, 4.

The front head 5 has an upper portion thereof formed with a discharge port 5*a* through which a refrigerant gas as compression medium is discharged, while the rear head 6 has an upper portion thereof formed with a suction port 6*a* through which for the refrigerant gas is drawn. The discharge port 5*a* communicates with a discharge pressure chamber 10 defined by the front head 5 and the front side block 3, and the suction port 6*a* with a suction chamber (low pressure zone) 11 defined by the rear head 6 and the rear side block 4, respectively.

A pair of compression spaces 12, 12 are defined at diametrically opposite locations between the inner peripheral camming surface la of the cam ring 1, the outer peripheral surface of the rotor 2, and the inner end faces of the front and rear side blocks 3, 4. The rotor 2 has its outer peripheral surface formed with a plurality of axial slits 13 at circumferentially equal intervals, in each of which a vane 14 is slidably fitted.

Figure 2:
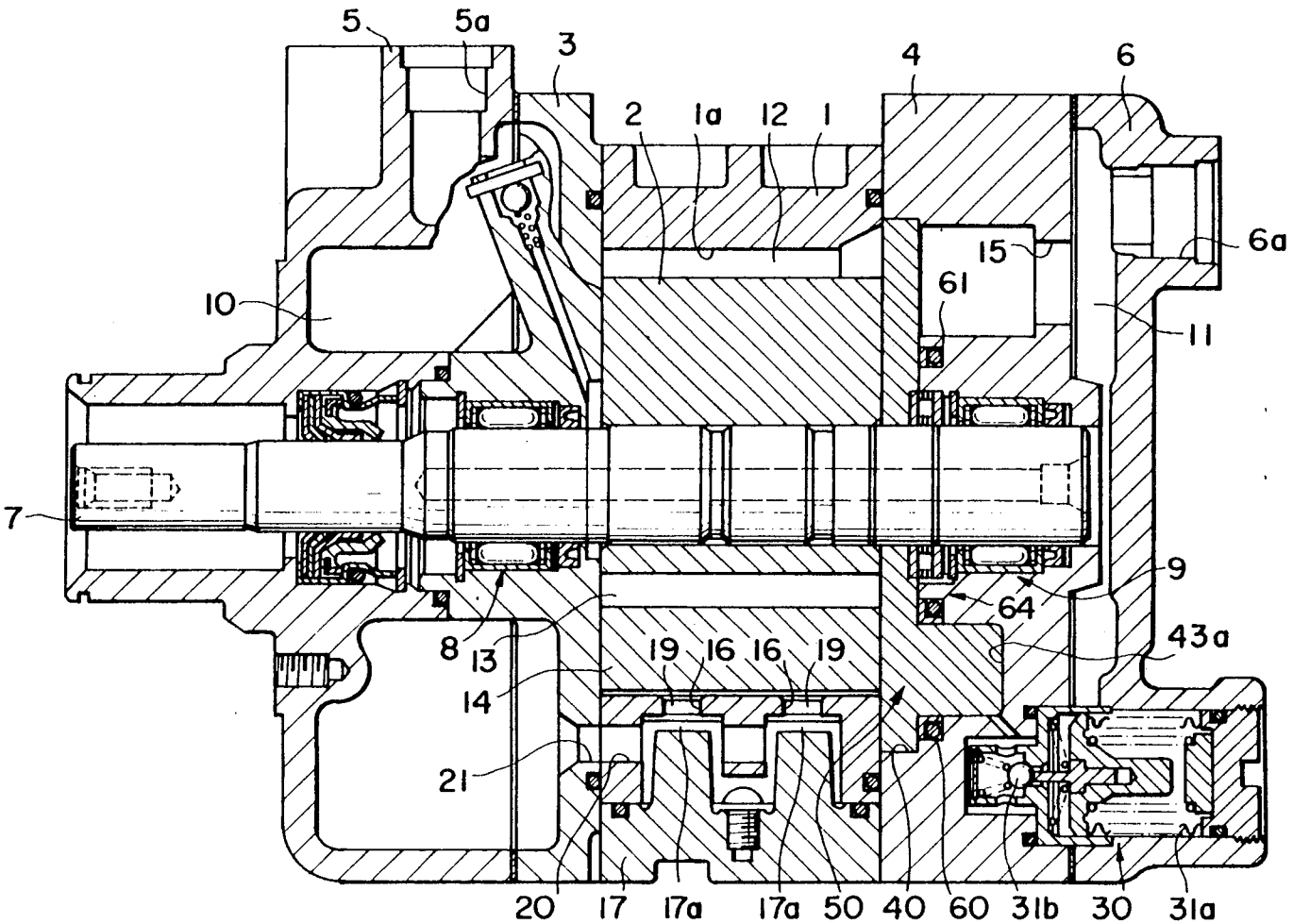
FIG. 2 is a longitudinal cross-sectional view of a variable capacity vane compressor according to a first embodiment of the present invention.
Figure 10:
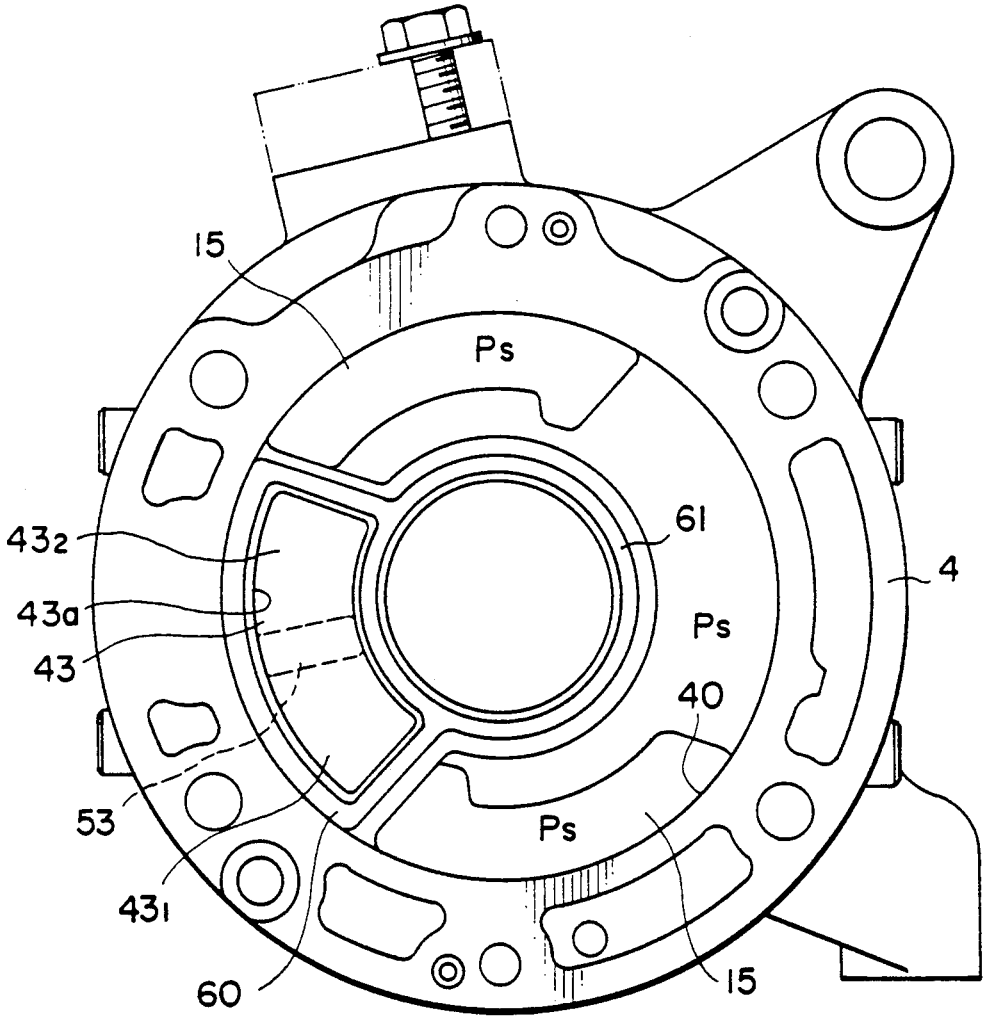
FIG. 10 is an end view of a rear side block of the compressor, as viewed from the rotor side.

The rear side block 4 is formed therein with a pair of refrigerant inlet ports 15, 15 at diametrically opposite locations as shown in FIGS. 2 and 10 (only one of them is shown in FIG. 2). Each refrigerant inlet port 15 axially extends through the rear side block 4 and communicates between the suction chamber 11 and the associated compression space 12.

Two pairs of refrigerant outlet ports 16, 16 are formed through respective opposite lateral side walls of the cam ring 1 at diametrically opposite locations (In FIG. 2, only one pair of refrigerant outlet ports 16 are shown). Secured to each of the opposite lateral walls of the cam ring 1 by a bolt, not shown, is a discharge valve cover 17 having valve stoppers 17*a*, 17*a*. Interposed between the lateral side wall and each valve stopper 17*a* is a discharge valve 19 retained by the discharge valve cover 17. Each discharge valve 19 opens in response to discharge pressure to thereby open the corresponding refrigerant outlet port 16. Defined by the cam ring 1 and the respective discharge valve covers 17 are a pair of communication passages 20 which each communicate with a corresponding pair of the refrigerant outlet ports 16 when the corresponding discharge valves 19 open. A pair of communication passages 21, 21 are axially formed through the front side block 3 at diametrically opposite locations, and communicate with the respective communication passages 20, 20. Thus, when the discharge valves 19 open to open the refrigerant outlet ports 16, compressed refrigerant gas is discharged from the compression space 12 into the communication passages 20, 21 through the refrigerant outlet ports 16, and then delivered into the discharge pressure chamber 10 to be discharged to the outside through the discharge port 5*a*.

Figure 3:
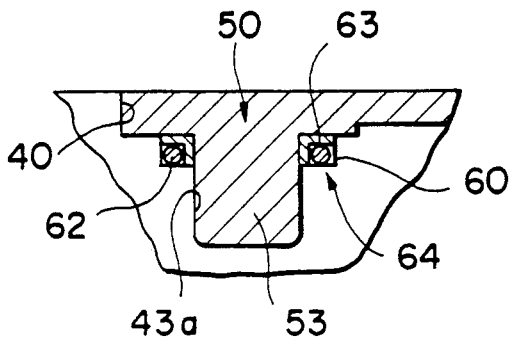
FIG. 3 is an enlarged sectional view of essential parts of the compressor of FIG. 1.
Figure 5:
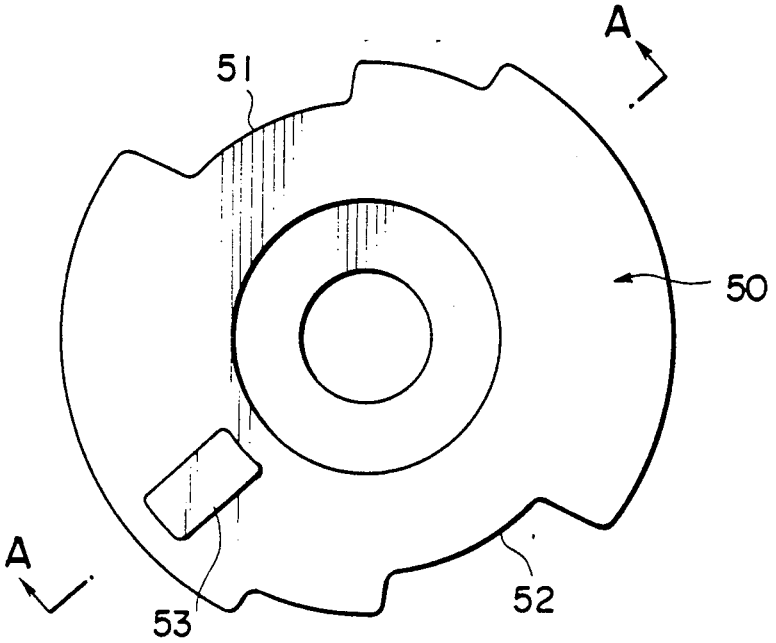
FIG. 5 is an end view of a control element employed in the compressor of FIG. 1.

As shown in FIGS. 2 and 3, the rear side block 4 has an end face facing the rotor 2, in which is formed an annular recess 40. An annular control element 50, best shown in FIG. 5, is rotatably received within the annular recess 40.

An arcuate recess 43*a* is formed in the bottom of the annular recess 43, and a pressure working space 43 is defined between the recess 43*a* and the control element 50 at a location intermediate between the refrigerant inlet ports 15, 15, as shown in FIG. 10.

Figure 7A:
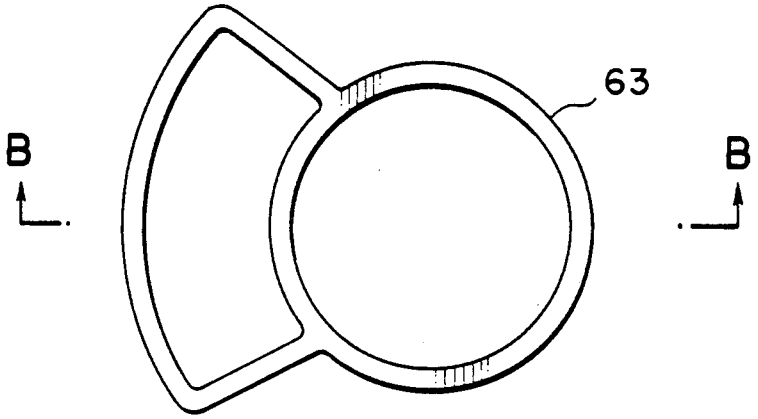
FIG. 7(*a*) is a plan view showing an auxiliary sealing member fitted around the control element.
Figure 7B:
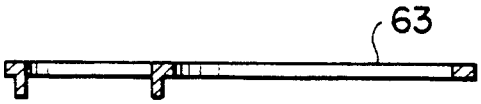
Figure 8:
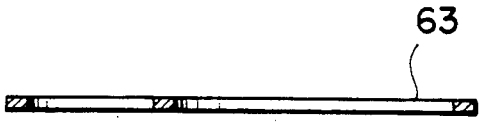
FIG. 8 is a sectional view showing another example of the sealing member.
Figure 9A:
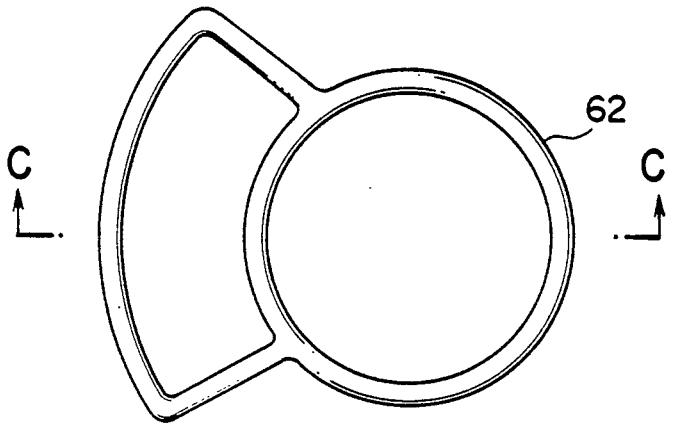
FIG. 9 (*a*) is a plan view of a resilient sealing member.
Figure 9B:
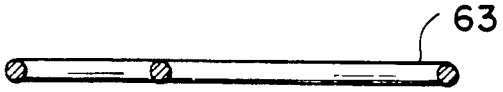

A seal-receiving groove 60 in the form of an arc is formed in the bottom surface of the annular recess 40, which extends along the peripheral edge of the arcuate recess 43*a*, while a seal-receiving groove 61 in the form of an annulus is formed in the bottom surface of the annular recess 40 at a location corresponding to the inner periphery of the control element 50. The grooves 60, 61 are continuous with each other. A resilient sealing member 62, shown in FIG. 9, which is formed of rubber or a like material, is fitted in these grooves 60, 61, and over which is fitted an auxiliary sealing member 63, shown in FIG. 7, which is formed of a resin having low coefficient of friction, such as fluorocarbon resin, e.g. Teflon. Thus, the pressure working space 43 is completely sealed by a composite sealing member (sealing means) 64 formed of superimposed sealing members 62, 63, as shown in FIGS. 2 and 3. The resilient sealing member 62 has a circular cross section as shown in FIG. 9 (*b*), while part of the auxiliary sealing member 63 has an L-shaped cross section as shown in FIG. 7 (*b*). However, the sealing member 63 may have a rectangular cross section as shown in FIG. 8.

Figure 4:
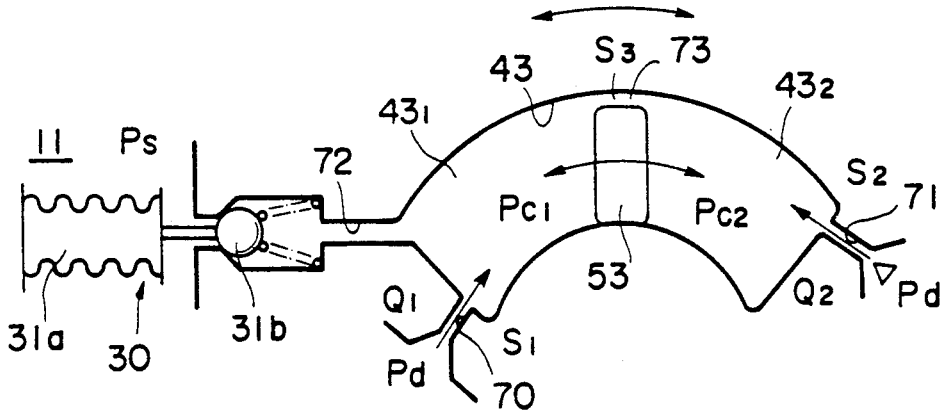
FIG. 4 is a schematic diagram showing a capacity control system of the compressor.
Figure 6:
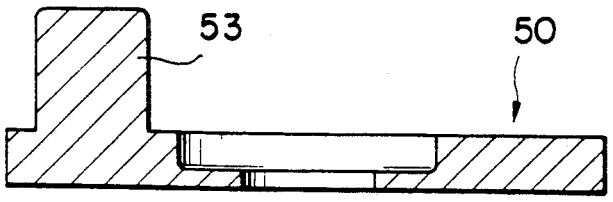
FIG. 6 is a sectional view taken along line A—A in FIG. 5.

The control element 50 has its outer peripheral edge formed with a pair of cutouts 51, 52 at diametrically opposite locations. It also has one side surface thereof remote from the rotor 2 provided with a pressure-receiving protuberance 53, as shown in FIG. 6. As shown in FIG. 4, the protuberance 53 is slidably fitted in the pressure working space 43 and divides same into a first pressure chamber $\mathbf{43}_1$ defined at one side of the protuberance 53 and a second pressure chamber $\mathbf{43}_2$ at the other side thereof.

The first pressure chamber $\mathbf{43}_1$ is supplied with discharge pressure Pd as high pressure from the discharge pressure chamber 10 through a high pressure-introducing passage 70, while the second pressure chamber $\mathbf{43}_2$ is supplied with the discharge pressure Pd in a restricted amount through a restriction passage 71 to create control pressure $PC_2$ therein. The high pressure-introducing passage 70 has a cross-sectional area much larger than that of the restriction passage 71.

The first pressure chamber $\mathbf{43}_1$ communicates with the suction chamber 11 as a low pressure zone through a communication passage 72. Arranged across the passage 72 is a control valve device 30 which is operable in response to change in the suction pressure Ps corresponding to change in the thermal load, to control pressure $PC_1$ within the first pressure chamber $\mathbf{43}_1$. The control valve device 30 comprises a bellows 31*a* arranged in the suction chamber 11 and expansible and contractible in response to change in the suction pressure Ps in the chamber 11, and a ball valve body 31*b* arranged in the communication passage 72 to open and close same in response to expansion and contraction of the bellows 31*a*. The communication passage 72 has a cross-sectional area 8 to 10 times as large as the cross-sectional area $S_1$ of the high pressure-introducing passage 70. Since according to the invention no sealing member is mounted on the pressure-receiving protuberance 53 of the control element 50, the amount of gas leaking between the first and second pressure chambers $\mathbf{43}_1$, $\mathbf{43}_2$ through a clearance 73 between the pressure-receiving protuberance 53 and the inner wall of the pressure working space 43 is much larger than that in the conventional compressor in which a sealing member is mounted on the pressure-receiving protuberance. The clearance 73 has an area $S_3$ smaller than cross-sectional area $S_2$ of the restriction passage 71. Therefore, the following relationship holds:

$$S_1 >> S_2 > S_3$$

Consequently, the flow rate $Q_1$ of discharge pressure Pd introduced into the first pressure chamber $\mathbf{43}_1$ through the high pressure-introducing passage 70 is much larger than the flow rate $Q_3$ of gas leaking through the clearance 73, while the flow rate $Q_3$ is smaller than the flow rate $Q_2$ of discharge pressure introduced into the second pressure chamber $\mathbf{43}_2$ through the restriction passage 71. Therefore, the following relationship holds:

$$Q_1 >> Q_2 > Q_3$$

Next, the operation of the variable capacity vane compressor constructed as above will be described.

Figure 11A:
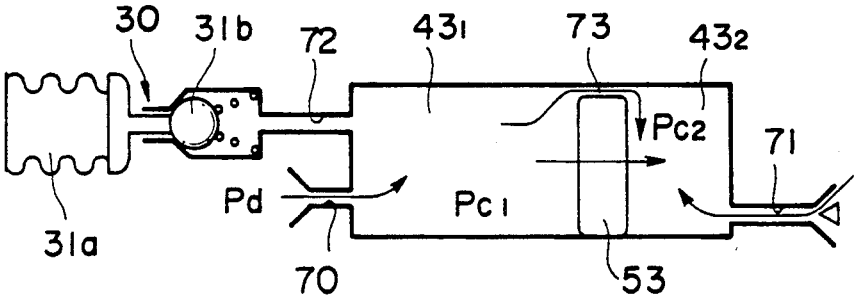
FIG. 11 (*a*) is a schematic diagram useful in explaining the operation of the control element in the maximum capacity position.
Figure 11B:
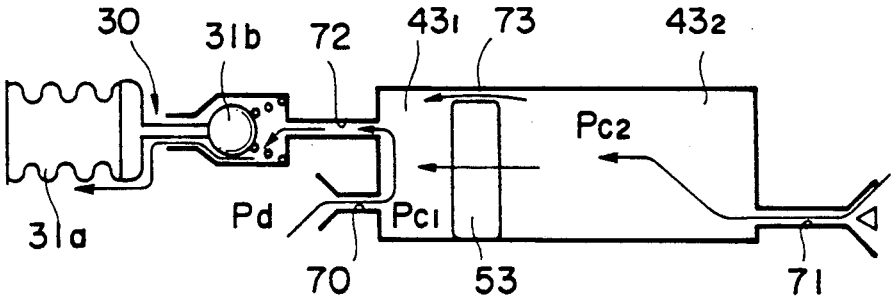

When the suction pressure Ps within the suction chamber 11 rises above a predetermined value with a change in the thermal load, the bellows 31*a* contracts and accordingly the ball valve body 31*b* closes the communication passage 72 to bring the control valve device 30 into a closed position as shown in FIG. 11 (*a*).

Since the cross-sectional area $S_1$ of the high pressure-introducing passage 70 is much larger than that $S_2$ of the restriction passage 71, the flow rate $Q_1$ of gas flowing into the first pressure chamber $\mathbf{43}_1$ is much larger than that $Q_2$ of gas flowing into the second pressure chamber $\mathbf{43}_2$. Consequently, the control pressure $PC_1$ becomes much higher than the control pressure $PC_2$ so that the control element 50 promptly rotates in the rightward direction as viewed in FIG. 11 (*a*). Then, the control pressure $PC_1$ leaks into the second pressure chamber $\mathbf{43}_2$ through the clearance 73 between the pressure-receiving protuberance 53 and the inner wall of the pressure working space 43 so that as time elapses, the control pressure $Pc_1$ in the first pressure chamber $\mathbf{43}_1$ becomes equal to the control pressure $PC_2$ in the second pressure chamber $\mathbf{43}_2$, whereby the control element 50 is brought into the maximum capacity position and stopped thereat without hunting.

When the control element 50 is in an intermediate position between the maximum capacity position and the minimum capacity position, where the control valve device 30 opens to an intermediate opening such that the ball valve body 31*b* meters the amount of gas flowing into the suction chamber 11 in response to expansion and contraction of the bellows 31*a*, the pressure-receiving protuberance 53 of the control element 50 moves alternately leftward and rightward until it becomes stable to a balanced position. For example, as the amount of gas flowing into the suction chamber 11 increases, the control pressure $PC_1$ decreases so that the control element 50 rotates leftward as viewed in FIG. 11 (*a*). At this time, control pressure $PC_2$ leaks into the first pressure chamber $43_1$ through the clearance 73, and when the control pressure $PC_2$ in the second pressure chamber $43_2$ becomes equal to the control pressure $PC_1$ in the first pressure chamber $43_1$, the control element 50 stops moving. Inversely, also when the amount of gas flowing into the suction chamber 11 decreases, a similar movement of the control element 50 in the opposite direction takes place.

When the suction pressure Ps decreases below the predetermined value, the bellows 31*a* expands to cause the ball valve body 31*b* to open to bring the control valve device 30 into a fully open position, as shown in FIG. 11 (*b*). Then, refrigerant gas introduced into the first pressure chamber $43_1$ through the high pressure-introducing passage 70 leaks into to the suction chamber 11 through the communication passage 72. However, since the amount of control pressure $PC_2$ leaking through the clearance 73 into the first pressure chamber $43_1$ is much smaller than the leak amount through the communication passage 72 so that the control pressure $PC_1$ becomes lower than the control pressure $PC_2$ and thereafter the relationship $C_1 < PC_2$ is maintained, whereby the control element 50 rotates in the leftward direction as viewed in FIG. 11 (*b*) and stopped at the minimum capacity position, without hunting.

According to the embodiment described above, the sealing member 64 is not mounted on the pressure-receiving protuberance 53, which greatly reduces the seal resistance. Further, the control element 50 is controlled in position by introducing high pressure into the first and second pressure chambers $43_1$, $43_2$ and positively utilizing the leakage of refrigerant gas through the clearance 73 between the pressure-receiving protuberance 53 and the inner wall of the pressure working space 43*a*, no torsion coiled spring is required, to thereby enable the control element 50 to be rotated with improved smoothness and hence enhance the startability and controllability of the compressor.

While in the above described embodiment, the control element 50 has only one pressure-receiving protuberance 53, and accordingly only one pressure-working space 43*a* is provided, each one pair of pressure-receiving protuberances 53, 53 and pressure-working spaces 43*a*, 43*a* may be provided at diametrically opposite locations, as shown in FIGS. 12–16, providing similar results to those provided by the aforedescribed embodiment.

Besides, according to this embodiment, the control element 50 can be prevented from being inclined.

Figure 12:
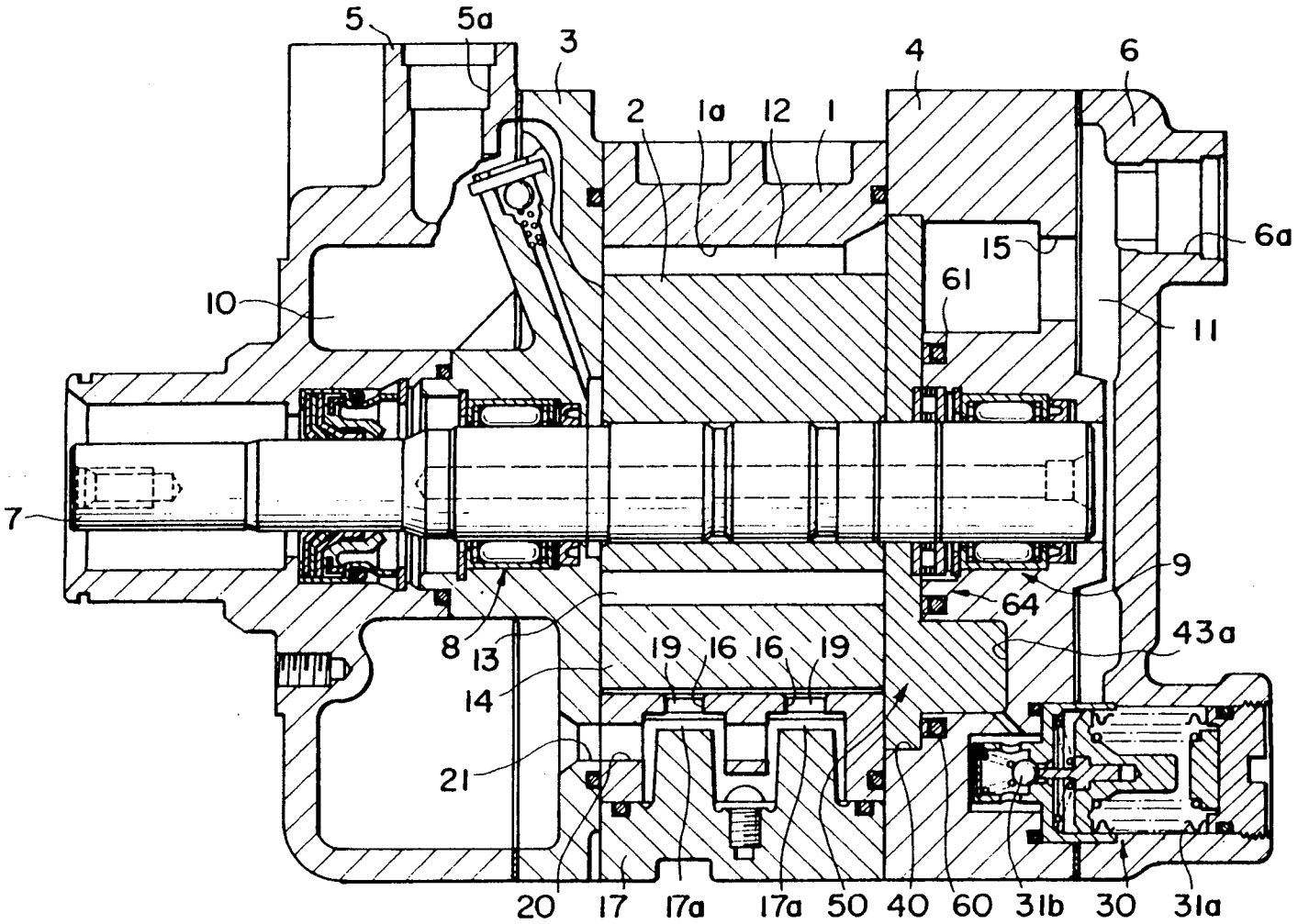
FIG. 12 is a longitudinal cross-sectional view showing a variable capacity vane compressor according to a second embodiment of the invention.
Figure 13:
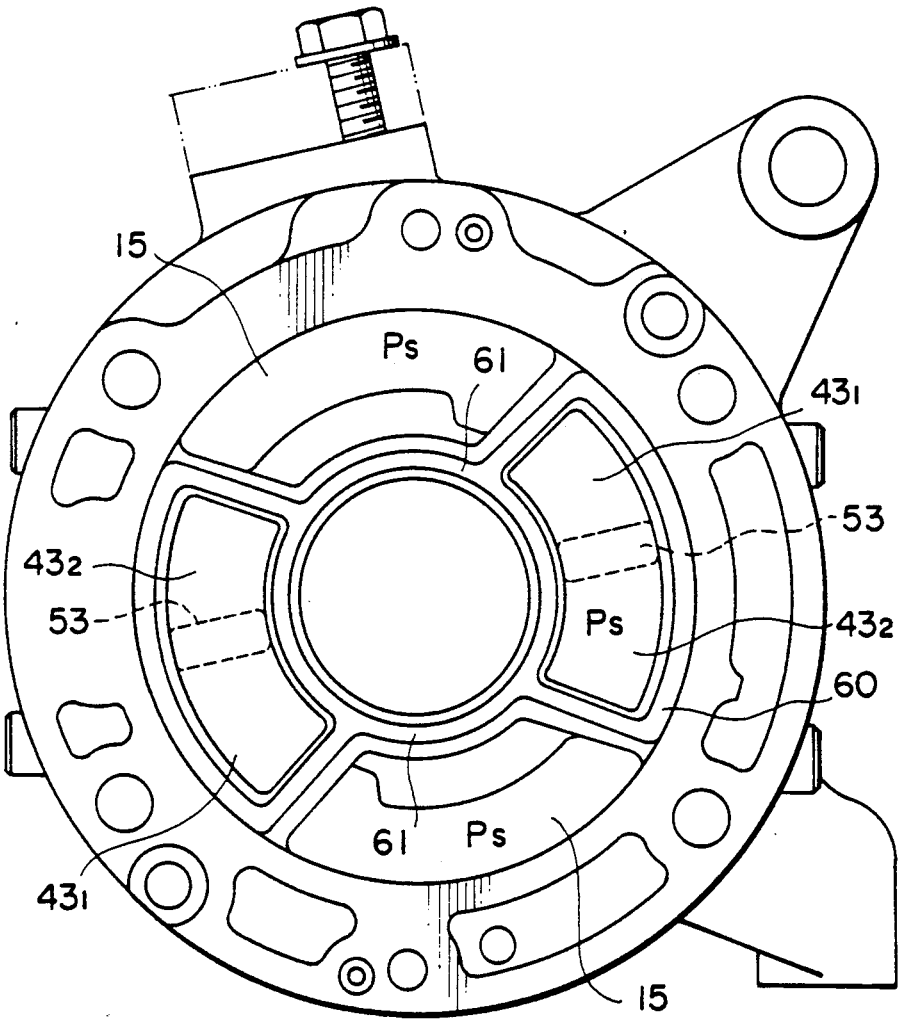
FIG. 13 is an end view showing a rear side block of the compressor of FIG. 12, as viewed from the rotor side.
Figure 14:
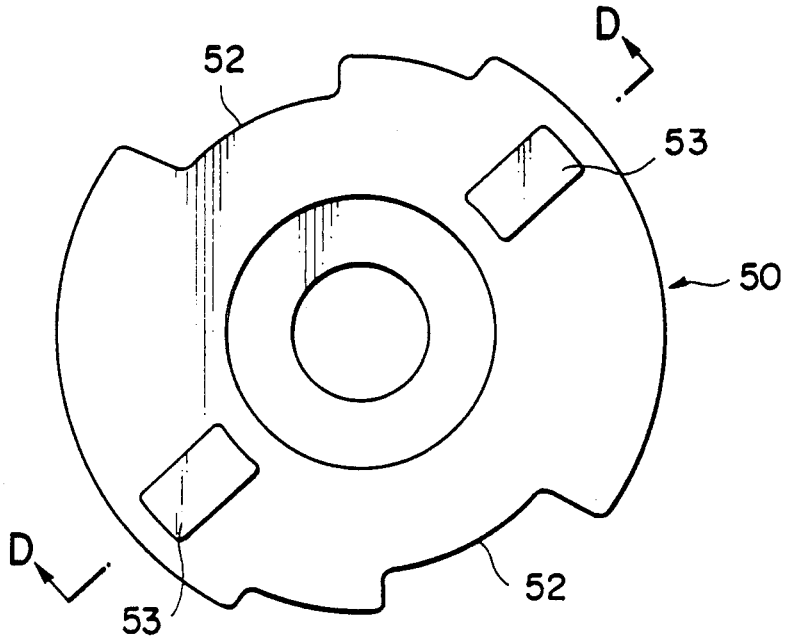
FIG. 14 is an end view showing a control element employed in the compressor of FIG. 12.
Figure 15:
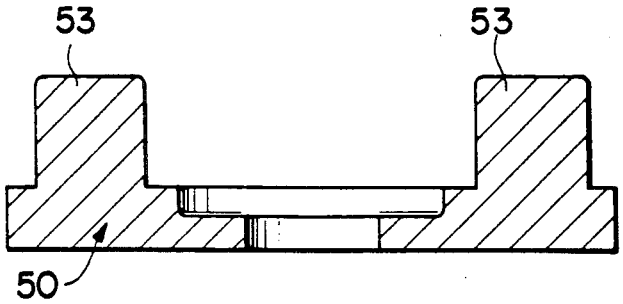
FIG. 15 is a sectional view taken along line D—D in FIG. 14.
Figure 16:
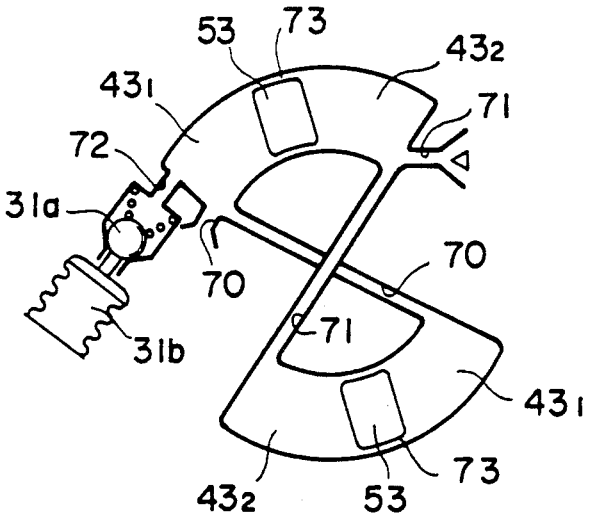
FIG. 16 is a schematic diagram showing a capacity control system of the compressor.

In this embodiment, the auxiliary sealing member 63 has a rectangular cross section, as shown in FIGS. 8 and 12. However, it may have an L-shaped cross section as shown in FIG. 7 (*b*).

What is claimed is:

1. In a variable capacity vane compressor including a cylinder having a pair of side blocks, a rotor rotatably received within said cylinder, one of said side blocks having an end face thereof facing said rotor, said end face having an annular recess formed therein and at least one second recess formed in a bottom of said annular recess, a control element rotatably received in said annular recess for varying the timing of compression commencement of said compressor, said control element cooperating with said second recess to define therebetween at least one pressure working space having an inner wall, said control element having at least one pressure-receiving protuberance slidably fitted in said pressure working space to divide said pressure working space into a first pressure chamber and a second pressure chamber, a communication passage extending between said first pressure chamber and a low pressure zone, and a control valve device arranged in said communication passage for opening and closing said communication passage in response to suction pressure, the improvement comprising sealing means provided in said bottom of said annular recess and engaging portions of said control element other than said pressure-receiving protuberance, a high pressure-introducing passage for introducing high pressure into said first pressure chamber, a restriction passage for introducing high pressure into said second pressure chamber, said high pressure-introducing passage having a cross-sectional area larger than a cross-sectional area of said restriction passage, said inner wall of said pressure working space and said pressure-receiving protuberance defining therebetween a clearance smaller than the cross-sectional area of said restriction passage.

2. A variable capacity vane compressor as claimed in claim 1, wherein said communication passage has a cross-sectional area larger than the cross-sectional area of said high pressure-introducing passage.

3. A variable capacity vane compressor as claimed in claim 2, wherein the cross-sectional area of said communication passage is 8 to 10 times as large as the cross-sectional area of said high pressure-introducing passage.

4. A variable capacity vane compressor as claimed in claim 1, wherein said second recess has a peripheral edge, said control element being an annular member having an inner peripheral edge, and said sealing member comprising a first seal-receiving groove formed in the bottom of said annular recess and extending along the peripheral edge of said second recess, a second seal-receiving groove formed in the bottom of said annular recess and extending along the inner peripheral edge of said control element, and a sealing member fitted in said first and second seal-receiving grooves.

5. A variable capacity vane compressor as claimed in claim 4, wherein said first seal-receiving groove is in the form of an arc.

6. A variable capacity vane compressor as claimed in claim 4, wherein said second sealing groove is in the form of an annulus.

7. A variable capacity vane compressor as claimed in claim 4, wherein said sealing member comprises a first sealing member having resiliency and fitted in said first and second seal-receiving grooves, and a second sealing member superimposed on said first sealing member.

8. A variable capacity vane compressor as claimed in claim 5, wherein said first sealing member is formed of rubber, and said second sealing member is formed of a resin.

9. A variable capacity vane compressor as claimed in claim 7, wherein said first sealing member has a circular cross section.

10. A variable capacity vane compressor as claimed in claim 7, wherein said second sealing member has at least part thereof having an L-shaped cross section.

11. A variable capacity vane compressor as claimed in claim 7, wherein said second sealing member has a rectangular cross section.

12. A variable capacity vane compressor as claimed in claim 1, wherein a pair of said pressure receiving protuberances and said pressure working spaces are provided at diametrically opposite locations.

* * * * *